US006646214B1

(12) United States Patent
Home

(10) Patent No.: US 6,646,214 B1
(45) Date of Patent: Nov. 11, 2003

(54) STRUCTURE OF AN IGNITION KNOB OF A GAS STOVE

(75) Inventor: William Home, Taipei (TW)

(73) Assignee: Grand Hall Enterprise Co., Ltd., Taipei (TW)

( * ) Notice: Subject to any disclaimer, the term of this patent is extended or adjusted under 35 U.S.C. 154(b) by 0 days.

(21) Appl. No.: 10/167,945

(22) Filed: Jun. 13, 2002

(51) Int. Cl.[7] ..... H01H 9/06
(52) U.S. Cl. ..... 200/61.86; 431/256
(58) Field of Search ..... 200/11 R, 61.85, 200/61.86, 564, 336; 431/256, 264, 266

(56) References Cited

U.S. PATENT DOCUMENTS 1,971,210 A * 8/1934 Cauli ..... 200/61.86
2,037,148 A * 4/1936 Reeves ..... 200/61.86
3,120,589 A * 2/1964 Westberg ..... 200/61.86
4,358,647 A * 11/1982 Demi ..... 200/61.86
4,371,764 A * 2/1983 Runion ..... 200/61.86
4,843,196 A * 6/1989 Bissig et al. ..... 200/336
5,525,771 A * 6/1996 Lund ..... 200/61.86

* cited by examiner

*Primary Examiner*—Michael Friedhofer
(74) *Attorney, Agent, or Firm*—Leong C. Lei

(57) ABSTRACT

An improved structure of an ignition knob of a gas stove is disclosed. The structure includes a gas supply tube mounted around a stove disc and passed through a gas tube of the gas stove, and a knob holder being turned to one end of the center thereof, and a gas flow axle valve being inserted with the axle end and a knob holder being actively turned a metal axle core of the gas flow axle valve. The gas flow of the stove disc at the extending shell end of the metal core of the gas flow axle valve, and a vertical projecting of a metal plate are overlapped and the metal plate is in eccentric towards the appropriate position of the core, and is secured with an L shaped block, where an L shaped block is a conductor covered by an insulator.

3 Claims, 6 Drawing Sheets

STRUCTURE OF AN IGNITION KNOB OF A GAS STOVE

BACKGROUND OF THE INVENTION

1. Field of the Invention

The present invention relates to an improved structure of an ignition knob of a gas stove, and in particular, one end of a knob holder of a body of a gas flow axle valve is provided with a metal core turning and is connected to the ignition supply of an electric circuit through conducting the passage of an electric socket device.

2. Description of the Prior Art

In early days, gas stove is used for BBQ and two knobs are mounted on the stove surface. One knob is turned to another end axle connecting a gas flow axle valve, and another knob is turned to another end axle connecting a spark switch. When in use, both hands need to hold each knob to turn on at the same time. It is too troublesome and dangerous. A user is very easily forgot to trigger both hands at the same time. The important of a simultaneous method by opening the gas ignition for the reason that if the gas is released first, gas poison may be occurred before the user triggers the stove to ignite.

Another type of stove that commonly used is that a single knob is mounted on the stove surface and the knob is turned to another end, and is plugged into the axle end of the gas flow axle valve, and a limit switch is provided with connecting the ignition supply of an electric circuit. If the limit position of the axle core of the gas flow axle valve is triggered, the limit switch senses the action and by conducting the ignition supply of the electric circuit and generating an electric spark, a stove disc is ignited. There is a need for more wires to connect the ignition supply of the electric circuit because of the limit switch being very precise. Another reason is that the joint for limit switch is tiny, and the seam of the joint will easily accumulate with carbon, or dirt block, causing the ignition supply of the electric circuit being unable to transmit, and the joint is disposed in an insulated shell inside where it is unable to seal and treat. Furthermore, if the limit switch is positioned at the side of the gas flow axle valve, an additional work of a limit switch frame is needed so as to mount it at an appropriate position. The production cost for such conventional stove will increase.

SUMMARY OF THE INVENTION

Accordingly, it is an object of the present invention to provide an improved structure of an ignition knob of a gas stove, wherein one end of a knob holder of the body of a gas flow axle valve is provided with a metal core turning, by connecting the ignition supply of an electric circuit through conducting the passage of an electric socket device so as to improve the ignition knob of the gas stove by having another fine-tune switch to provide an ignition function. The whole structure of the ignition knob of the gas stove is simple and is durable.

Yet another object of the present invention to provide an improved structure of an ignition knob of a gas stove, wherein an electric joint is formed from an axle core relative to a horizontal projecting edge of a L shaped block, a fan shaped conducting plate is sleeved in and a L shaped conductor is disposed at the side of the gas flow axle valve. When the knob is turned, the fan shaped conducting plate surface will slip over to the end of the L shaped conductor, so that the friction of the overlapping plate surface is formed and conducted. This structure will not easily accumulate with carbon. In addition, the electric joint is exposed and has an advantage of easy cleaning. If the friction of the overlapping plate surface is conducted simultaneously, the frictional function is formed. When the electric joint with accumulated carbon or dirt triggers the knob, the joint surface generating friction to scrap the accumulated carbon.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PRESENT INVENTION

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
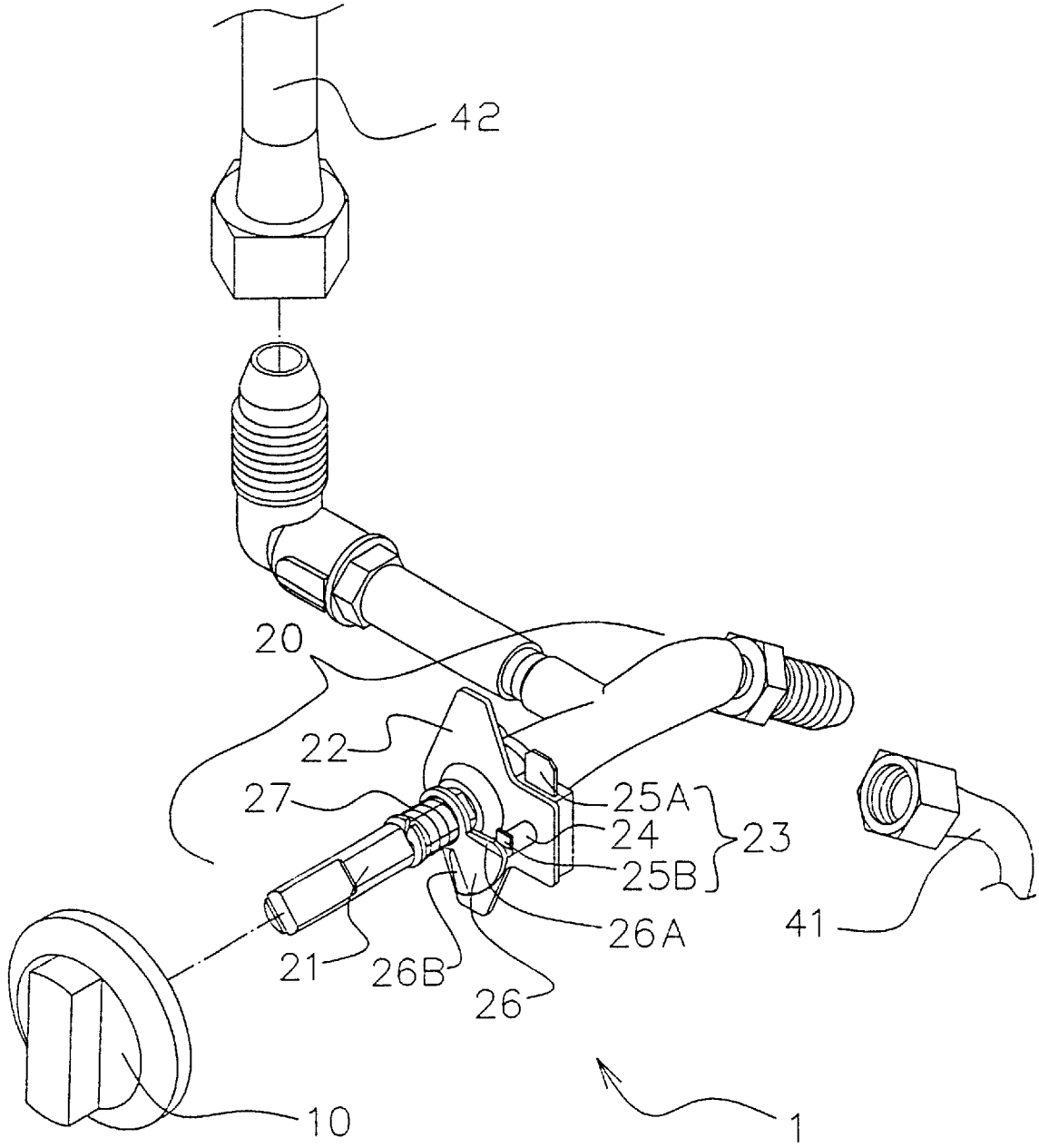
FIG. 1 is a perspective exploded view of an improved of an ignition knob of a gas stove of the present invention.
Figure 2:
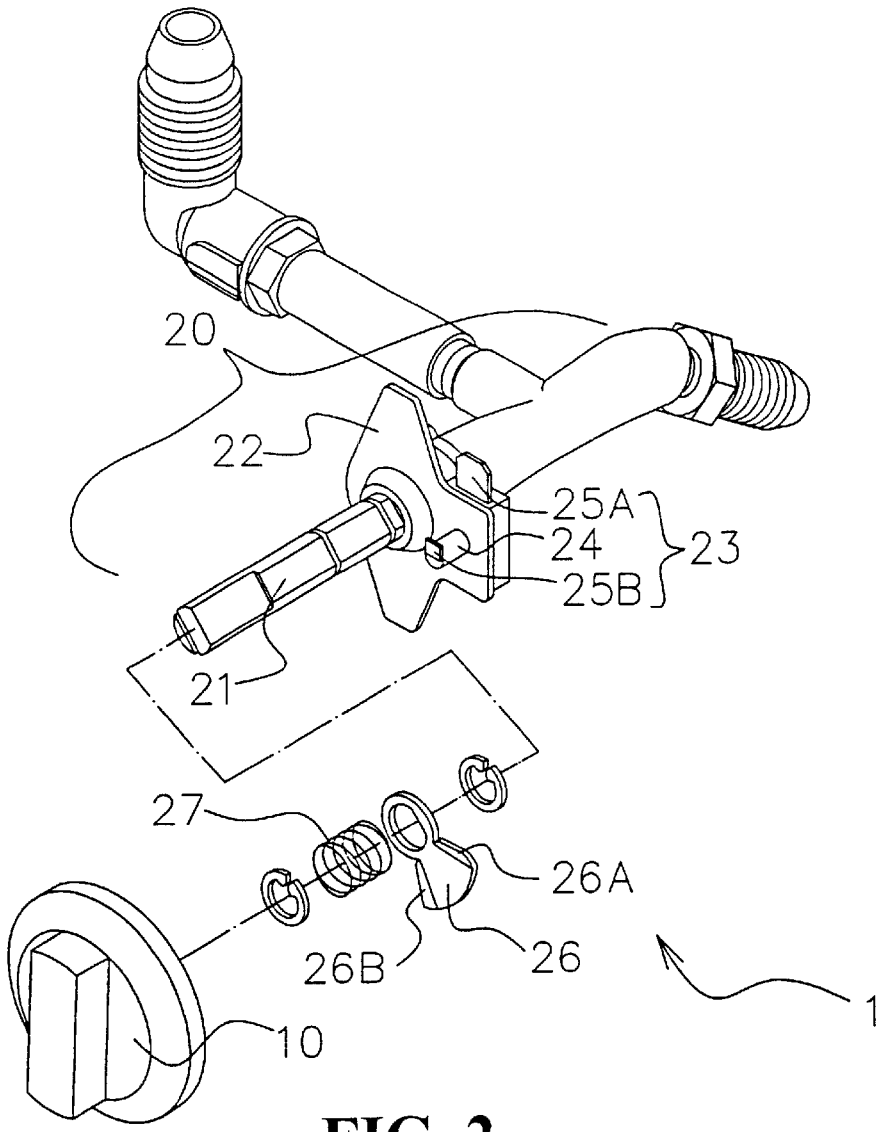
FIG. 2 is a perspective exploded view of the FIG. 1.
Figure 3:
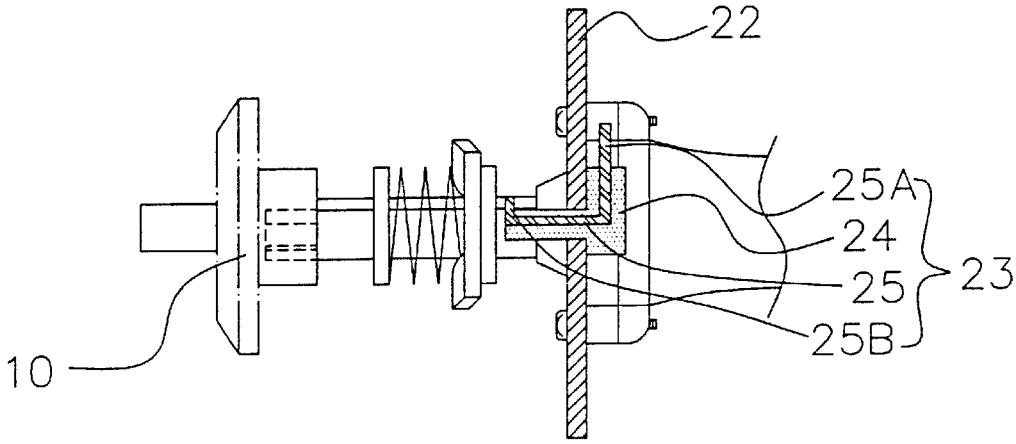
FIG. 3 is a cross-sectional view showing the L shaped block section of the L shaped conductor in accordance with the present invention.
Figure 4:
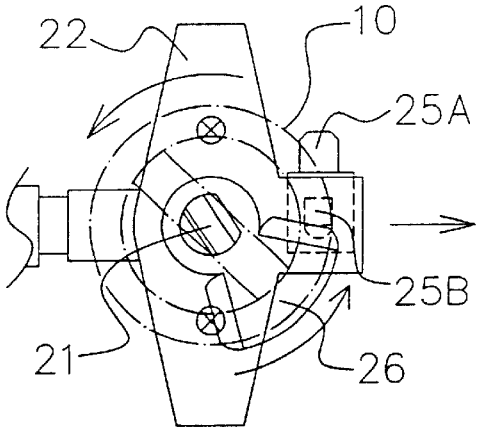
FIG. 4 is a plan view of an improved of an ignition knob of a gas stove before triggering the ignition of the present invention.

Referring to FIG. 1, FIG. 3 and FIG. 4, there is shown a kind of an ignition knob 1 of a gas stove, wherein a gas supply tube 41 is mounted around a stove disc and passed through a gas tube 42 of the gas stove. A knob holder 10 is turned to one end of the center thereof and a gas flow axle valve 20 is plugged in the axle end. The knob holder 10 has actively turned a metal axle core 21 of the gas flow axle valve 20, by regulating the gas flow of the stove disc, especially at the extending shell end of the metal core 21 of the gas flow axle valve 20, a vertical projecting of a metal plate 22 is overlapping mounted. The metal plate 22 is in eccentric towards around the appropriate position of the core 21, and is secured with an L shaped block 23, where an L shaped block 23 is an L shaped conductor 25 of a covered insulator 24. The projecting end of the conductor 25 is vertical extending towards a conducting piece 25A, by connecting the ignition supply of an electric circuit to the metal plate 22, or the conducting current for the shell and others of the axle core 21 can be interchangeable. The horizontal extending end at the axle core 21 alongside, a conducting connected plate 25B is parallel extended therefrom. The metal axle core 21 is corresponding with the horizontal extending edge of the L shaped block 23, and is sleeved in with a fan shaped conducting plate 26. If the knob 10 is turned, it will rotate the fan shaped conducting plate 26 to press the conducting connected plate 25B, such that the fan shaped conducting plate 26 will either turn to or turn away from the plate edge of the conducting connected plate 25B. Thus, it can form into slant faces 26A, 26B of the dislocated away from the conducting connected plate 25B, such that the fan shaped conducting plate 26 faces towards the metal axle core 21 of the knob 10, and a compressed spring 27 is provided to the conducting plate.

Figure 5:
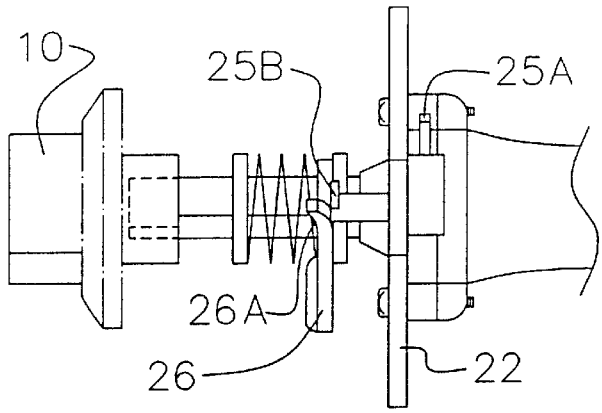
FIG. 5 is a side view of the FIG. 4.
Figure 6:
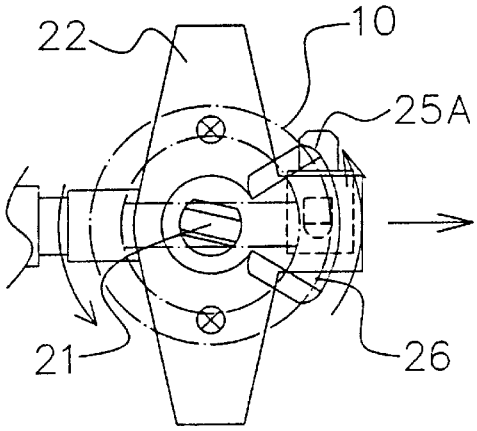
FIG. 6 is a plan view of an improved of an ignition knob of a gas stove when triggering the ignition of the present invention.
Figure 7:
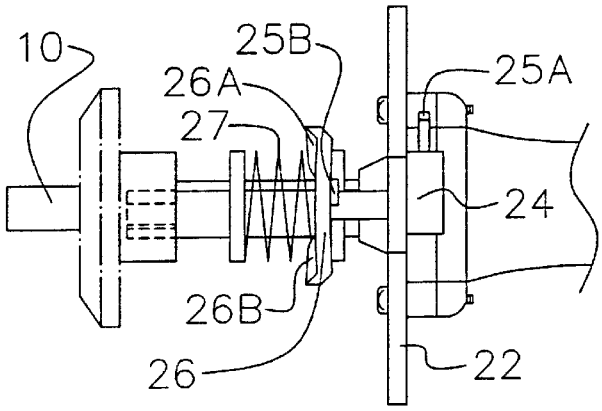
FIG. 7 is a side view of the FIG. 6.
Figure 8:
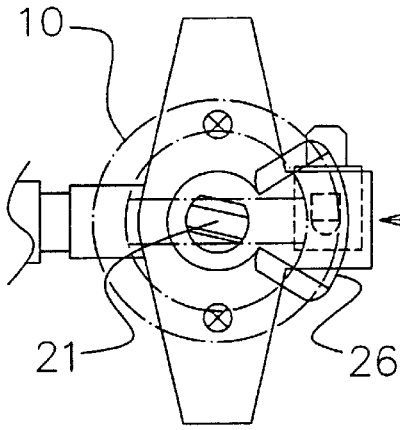
FIG. 8 is a plan view of an improved of an ignition knob of a gas stove when triggering the ignition of the present invention.
Figure 9:
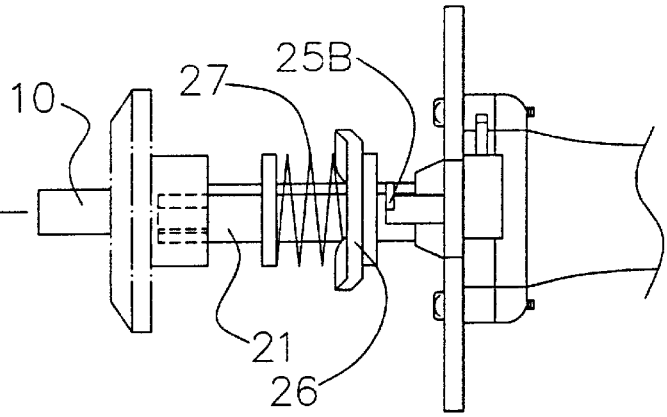
FIG. 9 is a side view of the FIG. 8.

If a user turns the knob 10 before ignition (referring to FIG. 4 and FIG. 5), the slant face 26A of the fan shaped conducting plate 26 will gradually turn to the front end at the plate edge of the conducting connected plate 25B, wherein the plate 26 and 26B will generate the slip squeezing friction with their plate surfaces. Then again the knob 10 is turned, as shown in FIG. 6 and FIG. 7, the slant face 26A of the fan shaped conducting connected plate 26 will gradually press the front end of the conducting connected plate 25B, wherein the spring 27 is pressed against the fan shaped conducting plate 26 and therefore the plate 26 and plate 25B will generate the tight overlapping friction with their plate surfaces. At this instance, a conduction passage is formed between the conducting piece 25A of the metal plate 22 by the conducting plate 26 so that the ignition supply of the electric circuit is connected and an instant electric spark ignition is produced. As shown in FIG. 8 and FIG. 9, once the user removes his hands, leaving the knob 10, the metal axle core 21 will be restored immediately. Thus, the fan shaped conducting plate 26 is kept away from the conducting connected plate 25B and the ignition supply of the electric circuit is cut off. The supply current for ignition will not provide ignition.

Figure 10:
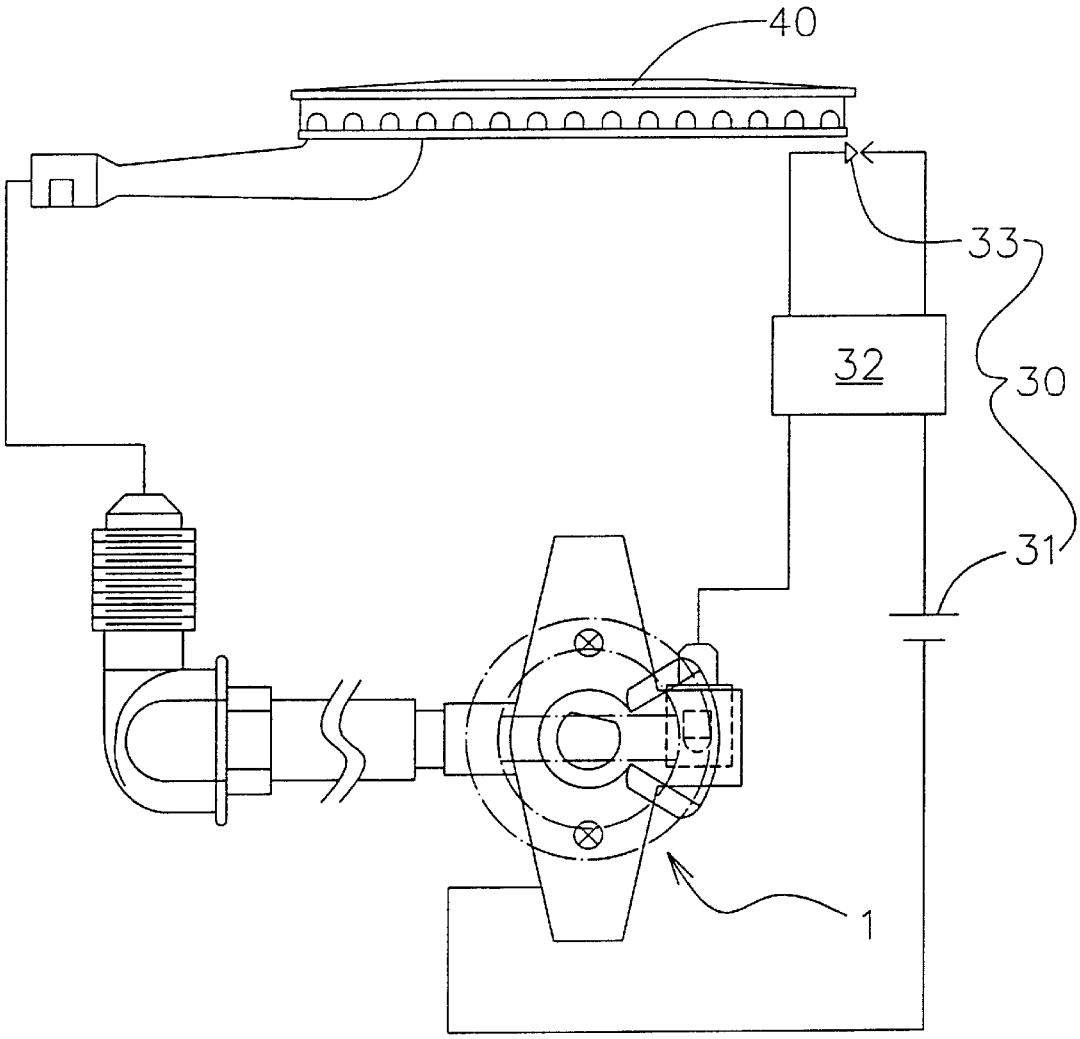
FIG. 10 is an improved of an ignition knob of a gas stove showing the connecting wire of the electric circuit of the preferred embodiment plan view in accordance with the present invention.
Figure 11:
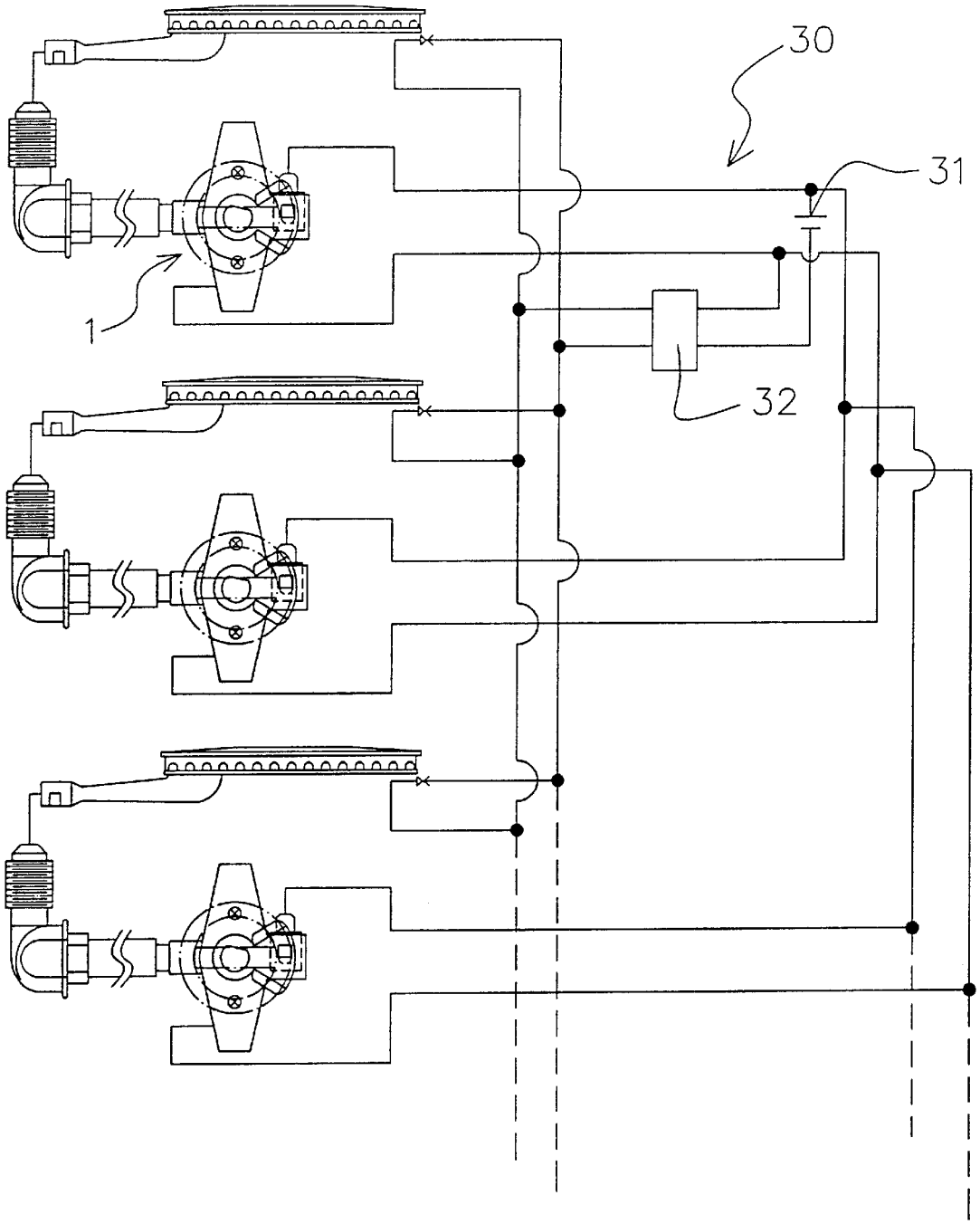
FIG. 11 is an improved of an ignition knob of a gas stove showing the connecting wire of the electric circuit of another preferred embodiment plan view in accordance with the present invention.

In conjunction with the ignition supply of the electric circuit, as shown in FIG. 10, a battery 31 be connected to the metal plate 22 at one terminal. Another terminal will be connected to a terminal a high voltage generator 32, and the primary terminal of the generator 32 is connected to the conducting piece 25A. The other secondary terminal of the generator 32 is connected to a spark generator close to the stove disc 40. When the ignition knob 1 of the gas stove is turned the ignition supply of the electric circuit 30 is switched on and it generates sparks to ignite the stove disc 40. The ignition supply of the electric circuit 30 is illustrated in FIG. 11, and a plurality of stove modules can be connected.

It will be understood that each of the elements described above, or two or more together may also find a useful application in other types of methodsdiffering from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An improved structure of an ignition knob of a gas stove having a gas supply tube mounted around a stove disc and passing through a gas tube of the gas stove, a knob holder having a center in which is inserted a gas flow axle valve having an axle end, the knob holder actively turning a metal axle core of the gas flow axle valve, wherein an axle end of the gas flow axle valve extends through an end of the metal core of the gas flow axle valve, a vertical projection of a metal plate is overlappingly mounted on the gas flow axle valve, the metal plate is in an eccentric position with respect to the core and is secured with an L shaped block, where the L shaped block is a conductor covered by an insulator, a projecting end of the conductor is vertically extending towards a conducting piece, by connecting an ignition supply of an electric circuit to the metal plate, a conducting connected plate is parallelly extended from the metal plate, the metal axle core corresponds to a horizontal extending edge of the L shaped block, the knob is capable of rotating a fan shaped conducting plate to press the conducting connected plate for an ignition supply of the electric circuit, and generating ignition of an electric spark means.

2. The device of claim 1, wherein the fan shaped conducting plate turns to or turns away from a plate edge of the conducting connected plate, forming a slanting face away from the conducting connected plate.

3. The device of claim 2, wherein the fan shaped conducting plate faces towards the metal axle core of the knob, and a compressed spring is mounted on the metal axle core to press a face of the conducting plate.

* * * * *